United States Patent [19]

Adams

[11] Patent Number: 4,495,668

[45] Date of Patent: Jan. 29, 1985

[54] MULTISTATE PRECIPITATION REMOVAL TOOL

[76] Inventor: Bruce M. Adams, 704 Felipe Pl., Sante Fe, N. Mex. 87501

[21] Appl. No.: 424,388

[22] Filed: Sep. 27, 1982

[51] Int. Cl.[3] ..... A47L 1/06

[52] U.S. Cl. ..... 15/105; 15/236 R; 15/245; 30/169

[58] Field of Search ..... 15/104 S, 236 R, 236 A, 15/245, 105; 30/169; 33/168 R

[56] References Cited

U.S. PATENT DOCUMENTS

| | | | |
|---|---|---|---|
| 1,554,242 | 9/1925 | Tanner | 15/245 |
| 3,651,014 | 3/1972 | Witsiepe | 528/301 |
| 3,763,109 | 10/1973 | Witsiepe | 528/301 |
| 3,766,146 | 10/1973 | Witsiepe | 528/301 |
| 3,816,010 | 6/1974 | DiRago | 33/168 R |
| 4,094,037 | 6/1978 | Karpp | 15/245 |

*Primary Examiner*—Robert W. Jenkins
*Assistant Examiner*—Arthur D. Dahlberg
*Attorney, Agent, or Firm*—Samuel M. Freund

[57] ABSTRACT

A multistate precipitation removal tool designed to remove light ice, snow, slush and liquid water from delicate surfaces and to polish frost thereon without harming such surfaces. Materials of appropriate hardness and flexibility over a broad range of temperature have been located and incorporated into a scraping-/polishing/squeegeeing tool for use, for example, in the small aircraft industry for preparing aircraft for take-off after precipitation has occurred. Critical in the function of the tool is that it does not damage delicate airfoil or windscreen surfaces while being used for its intended purpose.

24 Claims, 3 Drawing Figures

MULTISTATE PRECIPITATION REMOVAL TOOL

BACKGROUND OF THE INVENTION

The present invention relates generally to ice scrapers and more particularly to bladed, anti-scratch, multistate water precipitation removing tools for delicate surfaces.

Removal of ice, frost and slush from airplane wing surfaces and from airplane windscreens is a well-known flight safety necessity. More serious than the additional weight burden is the destruction of the wing lift due to the disruption of laminar flow caused by ice or frost. A mere 1/16" of rough, heavy frost can disastrously reduce wing lift. However, this same 1/16" of frost, once polished, has little effect on lift. Two options then exist: (1) removing all precipitation from the wing surface, or (2) polishing smooth any frost, crusty snow or rough ice. Large, commercial airline companies generally employ chemical deicers. That is, alcohols or other ice removing chemicals are sprayed on the wing surfaces and windscreens. However, these fluids are too heavy to carry on board an airplane in quantities necessary for effective deicing of large wings and are also dangerous to transport. Unfortunately, small and/or remote airfields do not ordinarily have the required deicing agents. Corporate and private aircraft owners must therefore utilize relatively crude mechanical means for snow and ice removal. Water and slush must also be removed by any means available because they will form frost and rough ice as the airplane taxis or takes off.

No tools exist in the aviation market for achieving the desired precipitation removal. Ordinary plastic ice scrapers prevalent in the automobile industry are useless since they can easily scratch airfoil surfaces and plastic windscreens. Household brushes and brooms, rags, sheets, ropes, and burlap bags are most commonly used by pilots to remove snow and to polish frost. Alcohol or hot air from an engine heater may be used on ice or the pilot may resort to solar melting or a heated hangar, if available. Water and slush are most usually removed using rags since industrial floor squeegees have metal frames that can gouge aluminum wings. They also incorporate rubber blades that become brittle and ineffective in cold weather, leaving streaks and blemishes on painted surfaces.

Wing surfaces are constructed of lightweight, easily damaged material. Dope and fabric have been used in the past. More recently, painted aluminum alloys, fiberglass and composite plastics are being used. However, all of these materials are easily gouged and permanently damaged by hard plastics resulting in an unairworthy airfoil. Moreover, sharp, hard plastic scrapers cannot ride over the rivets emplaced on the wing in the construction procedure; hard plastic blades then, generally either damage the rivets of break.

The difficulty in using softer plastics, which theoretically would approach the desired flexibility and hardness at lower temperatures, is the large range of temperatures at which further wing deicing is necessary. That is, pilots typically face ground temperatures of approximately 0 to −40 C. during and after a winter storm. Clearly what is needed is a material which is suitable for scraping, polishing and squeegeeing a wing surface or windscreen without damaging it and one which maintains its properties of flexibility and hardness relatively constant throughout this broad temperature range.

A series of commercially available, easily moldable, elastomers has been developed by E. I. duPont de Nemours and Co. under the Tradename, 'Hytrel', which combines the characteristics of rubbers and plastics. Resistance to stiffening at low temperatures is quite remarkable. Fortuitously, these synthetics include flexibilities appropriate to the requirements of the instant invention. Compositions soft enough to squeegee water from surfaces are included at one end of the list of available materials, while those hard enough to scrape off light ice are covered by the other end of the product list. Intermediate flexibility materials suitable for polishing frost are also available. Three relevant bulletins from E. I. duPont de Nemours and Co. describe these products: HYT-501A, "Mechanical Properties of 'Hytrel'"; HYT-001A, "Types, Properties and Uses of 'Hytrel';" and E-26276, "Engineering Guide to the duPont Elastomers", the disclosures of which are hereby incorporated by reference. The third of these publications lists 23 uses for these materials, none of which teaches my invention. These bulletins list the properties of 'Hytrel', but they should be regarded as properties which define the materials from which my tool can be fabricated should other materials possessing similar properties become available. The squeegee blades in two embodiments of my invention are fabricated from silicone rubber.

The tool of the instant invention is fabricated from these duPont Elastomers which allows it to be used to satisfy the need in the aircraft industry for a nondestructive, multistate water precipitation remover from wing surfaces and windscreens. Moreover, the nondestructive scraping action of my tool will permit paint removal from wing surfaces when it is used with appropriate solvents. The third of the bulletins cited hereinabove describes the insensitivity of 'Hytrel' to a wide variety of oils, fuels, solvents, and chemicals, thereby allowing its use as a paint scraper in the presence of these chemicals. Finally, my tool can be used for cleaning any delicate surface such as motorcycle windscreens, for example.

SUMMARY OF THE INVENTION

One object of the instant invention is to provide an apparatus for removing light ice from delicate surfaces such as airplane wings and windscreens, and motorcycle windshields without damaging these surfaces.

Another object of my invention is to provide an apparatus for polishing frost on airplane wing surfaces such that the turbulence resulting from such frost is minimal, again without damaging the wing surfaces.

Yet another object of the present invention is to provide an apparatus for squeezeeing water and slush from such delicate surfaces without damaging them.

A further object of my invention is to provide an apparatus for assisting in the removal of paint from airplane wing surfaces and other delicate surfaces without damaging them.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the apparatus of this invention may include several parallel blades which vary in flexibility from soft to stiff, each blade having a substantially constant, chosen flexibility. Further, each blade has a leading edge for scraping or squeegeeing precipitation off a surface, and is shaped so that it and/or a combination of blades may be held by hand. The leading edge of the softest blade is located forward of the next stiffest blade member which lies next to it, all of the stiffer blade members being recessed in a stepwise manner. The blades are rigidly and detachably fastened together away from the leading edges. Preferably, in one embodiment of my tool, blades are further rotatably attached at a point of fastening to permit them to be used separately or in various combinations. It is preferred that the softest member be able to squeegee water and slush from the surfaces to be operated on, that an intermediate flexibility member be able to polish frost and crusty snow on such surfaces in order to decrease the disruption of laminar flow, and a yet stiffer blade member be capable of removing light ice deposited thereon. All blade members must be able to conform to surface variations and additionally ride over rivets and other small protrusions without damaging them, both when the blades are used separately or in any combination. It is further preferred that the blade members be constructed of flat elastomeric plates with room temperature Durometer hardness values ranging from approximately 40D to 72D and constant within about 13% in the temperature range from approximately 0 to −40 C., and room temperature Clash-Berg Moduli of Rigidity ranging from approximately 2,100 psi to 19,000 psi for the 40D and 72D hardness materials, respectively, which Moduli change by a factor of about 7 between +23 and −40 C. Preferably also, the blades are fabricated from materials which include duPont 'Hytrel' polyester elastomers.

In a further aspect of the present invention, in accordance with its objects and purposes, the device hereof includes a handle which is located behind the leading edge, which may be fashioned out of the stiffest scraping member itself or from other, attached compositions, and which divides the tool into one with two scraping edges; a leading edge and a second edge. It is further preferred that for this embodiment the leading edge be a broad, stepped scraping surface for polishing frost, the steps aiding in insuring that the tool contacts the surface for a broad range of pressures applied to this edge by the operator applying downward pressure to the handle during the polishing motion, while the broad scraping surface prevents operating surface damage since the force applied to this surface is thereby reduced. It is also preferred that a flat, soft blade member be demountably and rigidly attached to the stiffest scraping member by recessed fasteners to prevent scratching the surface, such that the leading edge of the soft blade member protrudes beyond the leading edge of the stiffest member, and is contiguous thereto over its entire length. In another embodiment of the instant invention an alternate blade for the flat, soft blade member, which will allow more efficient squeegeeing of delicate windscreen surfaces, is a blade fabricated from soft material which lays flat against the stiffest member up to its leading edge, whereupon it angles away from the plane of the stiffest member and in a direction opposite to the stepped surface of the stiffest member. Both kinds of squeegee blades may be unfastened from the stiff blade, rotated 180°, and resecured in an out-of-the-way position or completely removed from the stiff blade. It is further preferred that the second edge of the stiffest blade of this embodiment of my tool be formed into a stepped scraping surface for scraping light ice from surfaces. This scraping edge is narrower than the leading edge to allow greater force to be exerted on the surface to be cleaned. Preferably, the softest flat blade member and its alternate, the angled, squeegee blade, are fabricated from silicone rubber with A.M.S. specification numbers of 3302D or 3303F, which correspond to room temperature Durometer hardness values of 50A or 60A, respectively. Preferably, also, the stiffest blade of this embodiment of my invention is fabricated from elastomeric material with room temperature Durometer hardness values ranging from approximately 50D to 72D and constant to within about 13% in the temperature range from about 0 to −40 C., and with room temperature Clash-Berg Moduli of Rigidity ranging from about 8,800 psi to 19,000 psi, respectively, which Moduli change by less than a factor of approximately 7 between +23 and −40 C. It is further preferred that both embodiments described hereinabove be fabricated out of materials which are chemically resistant to fuels and deicing fluids and also be resistant to sunlight while at the same time fuel must adhere to these materials. Preferably also, the fabrication materials include duPont 'Hytrel' polyester elastomers. The blade members may also be injection molded or extruded. Finally, it is preferred that the narrow, second edge of the second embodiment of my tool be of such a size that it fits into an aircraft fuel tank and the handle be so calibrated and scribed that when inserted into a fuel tank up to the rear portion of the broad stepped scraping surface, a measurement of the fuel level is obtained from the location of the liquid line along the scribed handle when it is withdrawn from the tank.

In a further aspect of the present invention, in accordance with its objects and purposes, the device hereof includes a single, flat, anti-scratch blade with a narrow leading edge for removing light ice, adapted to be held by hand, and formed from elastomeric material with room temperature Durometer hardness values ranging from approximately 50D to 70D and constant to within about 13% in the temperature range from approximately 0 to −40 C., and with room temperature Clash-Berg Moduli of Rigidity ranging from about 8,800 psi to 19,000 psi, respectively, which Moduli change by less than a factor of approximately 7 between +23 and −40 C. The group of fabrication materials should preferably include duPont 'Hytrel' polyester elastomers.

In yet a further aspect of my invention, in accordance with its objects and purposes, the device hereof may also include a single, flat anti-scratch blade with a broad leading edge for polishing frost, adapted to be held by hand, and formed from elastomeric material with room temperature Durometer hardness values ranging from approximately 50D to 70D and constant to within about 13% in the temperature range from approximately 0 to −40 C., and with room temperature Clash-Berg Moduli of Rigidity ranging from about 8,800 psi to 19,000 psi, respectively, which Moduli change by less than a factor of approximately 7 between +23 and −40 C. The group of fabrication materials should preferably include duPont 'Hytrel' polyester elastomers. Preferably also, both of the above-mentioned single-bladed tools have their leading edges formed into a stepped scraping surface to increase the area of contact with the surface to be operated on, thereby increasing the efficiency of my invention.

The tool of the instant invention, then, provides a means for removal of snow, slush, freezing rain, and light ice from delicate surfaces, and for polishing frost thereon without damaging such surfaces. Moreover, my tool is capable of riding over rivets and other small wing surface protrusions while conforming to the wing surface. The combination of capabilities in a nondestructive tool is of great importance in the aircraft industry. Previous mechanical precipitation removers and polishers have included brooms, ropes and burlap sacks, all providing inefficient and incomplete performance. The present invention overcomes the inadequacy of these devices. Among other advantages, my invention can also be used to remove paint from delicate surfaces by bringing appropriate solvents into more complete contact with the paint.

BRIEF DESCRIPTION OF THE DRAWINGS

The accompanying drawings, which are incorporated in and form a part of the specification, illustrate three embodiments of the present invention and, together with the description, serve to explain the principles of the invention. In the drawings.

DETAILED DESCRIPTION OF THE INVENTION

Figure 1:
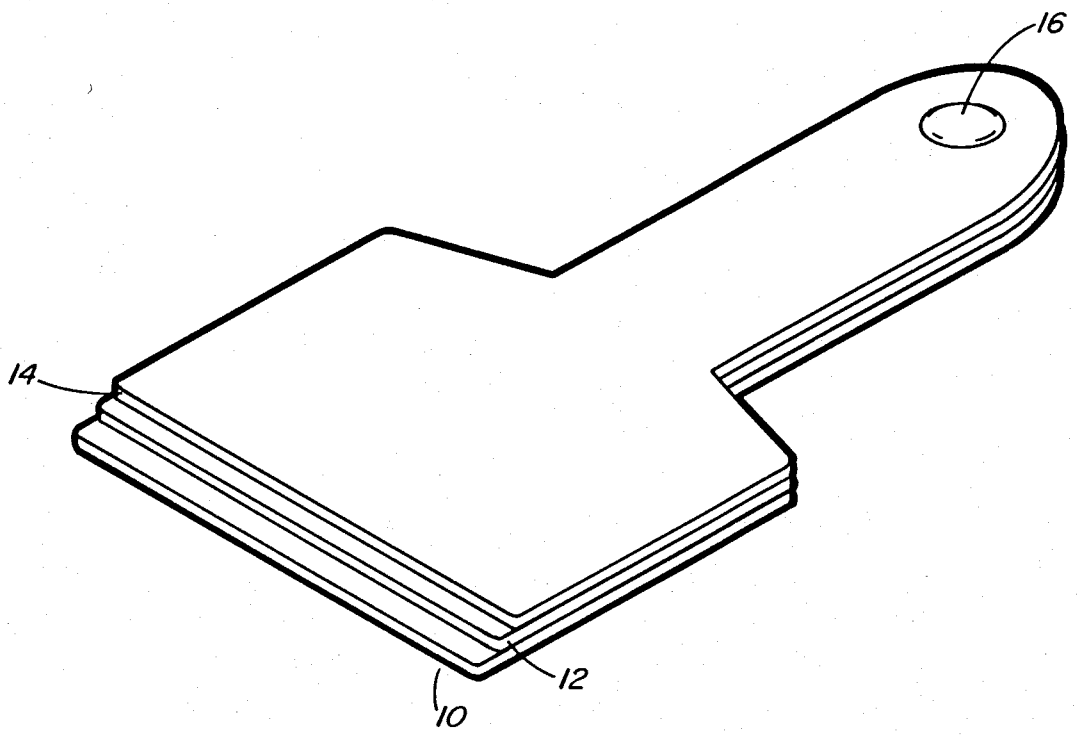
FIG. 1 is a schematic representation of a three-bladed squeegee/deicer/polisher tool.

Reference will now be made in detail to the present preferred embodiments of the invention, examples of which are illustrated in the accompanying drawings. Turning now to these drawings, and in particular to FIG. 1 wherein a schematic representation of a three-bladed squeegee/scraper/polisher tool is depicted, which is hereinafter referred to as the first embodiment of my invention, this tool is constructed from a flat, soft blade 10, one of intermediate flexibility 12, and one of having stiffer characteristics 14. The three flat, 3" wide, 0.08" thick blades are rotatably fixed by fastening means 16 behind the narrowed portion which permits the tool to be hand held in a variety of combinations. That is, any of the blades may be rotated out of the way depending on the type of precipitation to be removed, or used together as shown.

Figure 2:
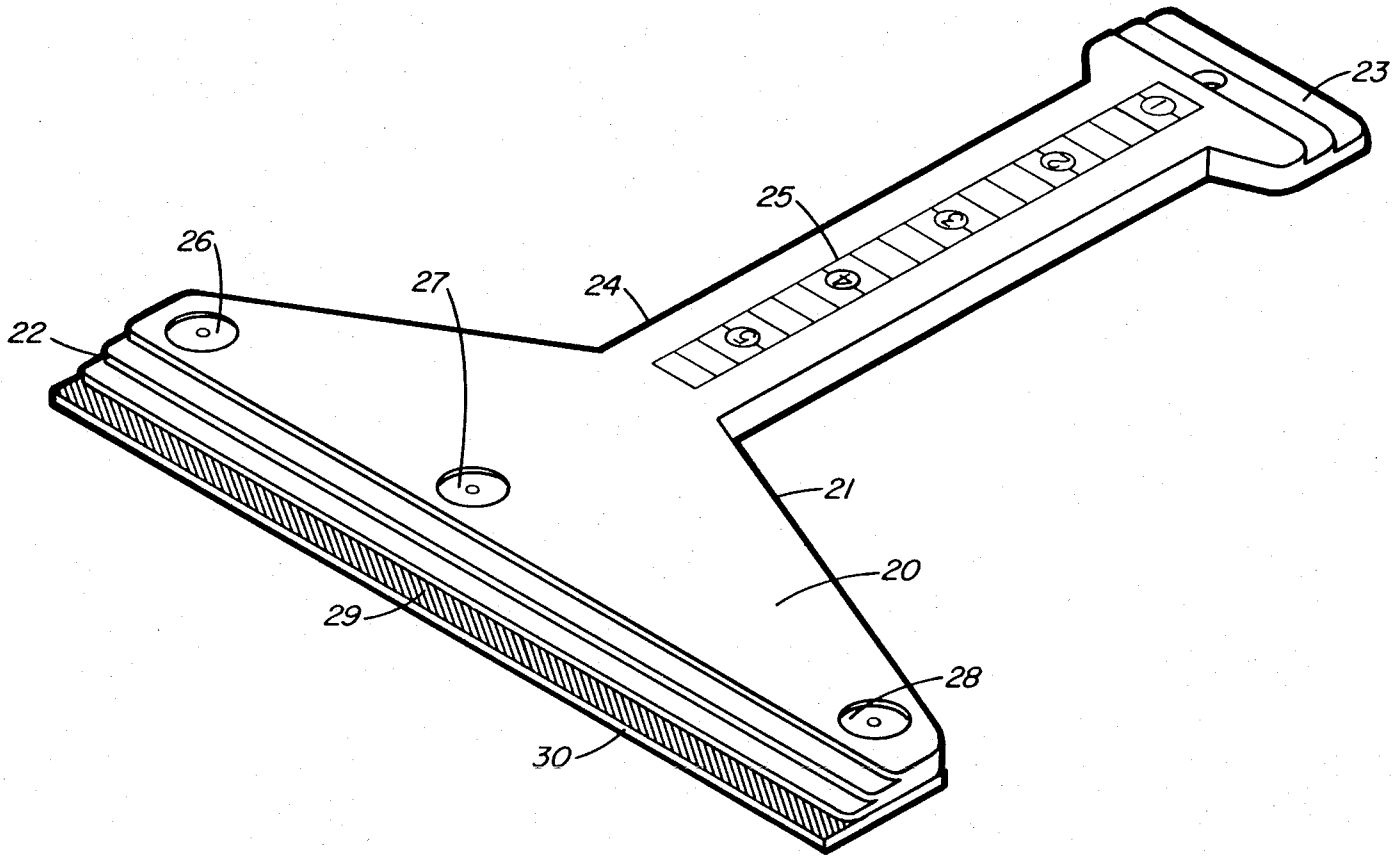
FIG. 2 is a schematic representation of a two-bladed squeegee/deicer/polisher/fuel-gauge tool.

FIG. 2 is a schematic representation of a larger, two-bladed squeegee/polisher/scraper/gas gauge tool, which is hereinafter referred to as the second embodiment of my invention. This tool design includes a stiff flexibility principal member 20 which is fashioned into a broad (8" wide, 0.24" thick), stepped polishing edge 22, and a narrower (2" wide, 0.24" thick), stepped scraping edge 23 with a handle 24 in between. The steps are about 0.08" deep for both edges. The handle may be of different material than the broad 22 and narrow 23 edge regions, but is here depicted as fashioned from the same material as these regions. It is further possible that the broad edge, handled and narrow edge compositions may all differ and suitable means of attachment be provided to give the tool similar shape and function to the embodiment shown in this figure. It should be pointed out that for maximum ease of use the handle should not be fabricated from very stiff material since the flex of this element prevents the tool operator's knuckles from contacting the surface operated on. Recessed fastening means 26, 27, 28 allow the detachable location of a soft, flat blade 29 against the principal member 20 without danger of scratching the surface to be operated on. The leading edge 30 of the soft blade 29 is located forward of the stiff blade's polishing edge 22 for squeegeeing water and slush from a surface when used in direct contact with this surface. When the tool is used for polishing frost, however, the stepped edge is used face down and the soft member's leading edge moves up and out of the way as the handle of the tool flexes and barely contacts the surface being polished. The narrower scraping edge 23 of the stiff member 20 is made small enough to fit into an airplane fuel tank opening. This is of great importance to pilots since small aircraft fuel gauges are unreliable. The tool is allowed to drop into the tank until it is stopped by the rear portion 21 of the broad polishing edge 22. Markings 25 on the tool's handle 24 permit the fuel level to be determined by locating the position of the highest position of fuel wetting the handle when the tool is withdrawn from the tank. The tool design is such as to make it impossible to drop into a fuel tank cell and also so as not to strike the cell's bottom. The tool then serves as a fuel gauge which will not damage delicate aircraft wing fuel tanks.

Figure 3:
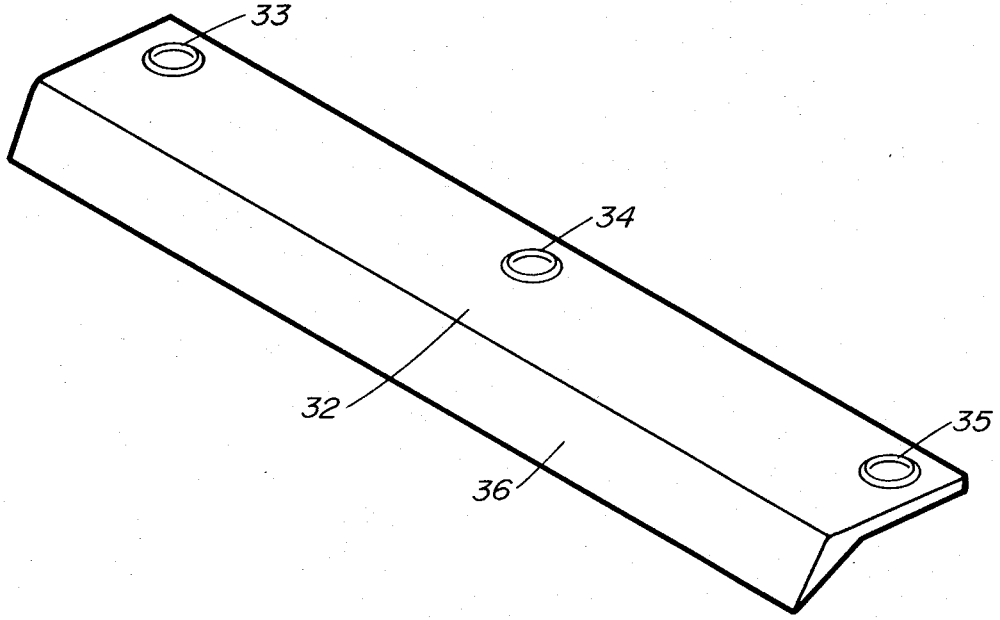
FIG. 3 is a schematic representation of an alternate squeegee blade member for the tool shown in FIG. 2 for more efficient removal of water and slush from windscreens.

FIG. 3 shows an alternate squeegee blade 32 to the one shown in FIG. 2, 29. My tool, when used with this blade, is hereinafter referred to as the third embodiment of the present invention. Means 33, 34, 35 are provided for attaching this blade member to the recessed attachment means 26, 27, 28 of the stiff blade. This blade is much more effective for squeegeeing slush and water from windscreens than the flat squeegee blade 29 which is more useful as a wing surface squeegee for slush and water, as a means for bringing alcohol and ice into more direct contact during chemical wing deicing procedures, and for non-abrasive ice removal from windscreens. The alternate squeegee blade 32 can also serve as a whiskbroom for loose frost on wing surfaces after the broad surface 22 of the stiff blade 20 has been used to polish the bulk of the frost. Similarly to the flat squeegee member 29, leading edge 36 of the alternate squeegee member moves out of the way when the stepped edge 22 of the stiff blade is used for polishing frost.

It should be mentioned that the blade members of both the first and second embodiments of the instant invention are not sharpened at their leading edges. They all have edges squarely faced-off to the blade surface. The reason for this is that the square edge wears much better and, more importantly, allows the blade to ride over rivets and other small protrusions on a wing surface. However, the alternate squeegee blade 32 in the third embodiment of my invention has a sharp leading edge 36 to improve its surface contour following characteristics.

The blade members of the three described embodiments of my invention for example, can be fabricated as follows:

1. First embodiment: a. squeegee: 40D hardness, 2100 psi Clash-Berg Rigidity, 'Hytrel' 40D, 0.08" thick, 3" wide;
   b. frost polisher: 55D hardness, 8,800 psi Clash-Berg Rigidity, 'Hytrel' 55D, 0.08" thick, 3" wide; and c. light ice scraper: 72D hardness, 19,000 psi Clash-Berg Rigidity, 'Hytrel' 72D, 0.08" thick, 3" wide.

Distances from the leading edge of the blade members of this embodiment to the beginning of the handle portion range from about 2½" to about 3" to insure the proper flex of these blades.

2. Second embodiment: a. stiff blade: 55D hardness, 8,800 psi Clash-Berg Rigidity, 'Hytrel' 55D, 0.24" thick, 8" wide broad edge, 2" wide narrow edge; and b. flat squeegee blade: 50A hardness, A.M.S. specification number 3302D, silicone rubber, 0.125" thick, 8" wide.

3. Third embodiment: a. stiff blade: 55D hardness, 8,800 psi Clash-Berg Rigidity, 'Hytrel' 55D, 0.24" thick, 8" wide broad edge, 2" wide narrow edge; and b. sharp squeegee blade: 60A hardness, A.M.S. specification number 3303F, silicon rubber.

Note that all hardness and flexibility figures correspond to their room temperature (23 C.) values, and that two Durometer scales exist); Durometer A for rubbers and Durometer D for plastics. Moreover, the temperature range for which mechanical precipitation removal is most important is between about 0 and −40 C. This is precisely the reason that DuPont 'Hytrel' polyester elastomers were selected as the material of choice for all of the scraper and polishing blades, and for some of the squeegee blades. For example, FIG. 3 and Table VI of Ref. 1, supra, show the slow variation of hardness and flexibility with temperature, respectively. The resistance to stiffening at low temperatures is particularly noteworthy and permits the various blade members to retain their nondestructive characteristics over a broad temperature range. The silicone rubber employed for some of the squeegee blades is well-characterized by the above-mentioned A.M.S. specification numbers which can be related to physical properties of materials used by the U.S. Department of Defense by consulting the appropriate U.S. government bulletins. The broad, stepped scraping surface is designed to polish frost with a maximum of efficiency. The steps insure at least one polising edge contacts the frost over a wide range of applied pressure. The narrower, stepped scraping surface is used for scraping crusty snow and light ice from surfaces since greater force may be exerted than with the broader edge. The squeegee blades are used for squeegeeing water or slush from surfaces and in two embodiments of my invention (second and third) may be unsnapped from the stiff blade and completely removed or rotated 180° and resecured in an out-of-the-way position. Only one of the two squeegee blades may be stored in this manner at one time, however. On very delicate surfaces it may be necessary to use only the soft squeegee blades to avoid damage.

The first embodiment of my invention is fastened together with a double-sided snap to more easily enable various blade combinations to be available. To treat frost, all three blades are used together, soft blade down. This configuration simultaneously removes loose frost, and polishes more stubborn frost. For crusty snow, the hard and medium blades are used, medium blade down; the soft blade being rotated out of the way. To chip light ice, only the hard blade is used. Again, only the soft blade is used on plastic windscreens.

For all three above described embodiments of my invention, the blades must be wiped clean before use. Periodically, all blades might be dressed with a fine file to avoid ragged edges.

My invention has addressed and solved a long standing problem in the small aircraft industry, that of mechanical removal of liquid and solid-state precipitation from delicate wing and windscreen surfaces. Previous procedures were neither effective nor efficient. The tool of the present invention provides a convenient, efficient and effective way to remove or polish such precipitation without damaging the surfaces to be operated on.

The foregoing description of several preferred embodiments of the invention has been presented for purposes of illustration and description. It is not intended to be exhaustive nor to limit the invention to the precise forms disclosed, and obviously many modifications and variations are possible in the light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A tool for removing ice, snow and slush from delicate surfaces, polishing frost, and squeegeeing water thereon without damage to these surfaces, which tool comprises in combination:

a. a plurality of substantially parallel blade members, each of said blade members having a substantially constant, chosen flexibility, said blade members varying in flexibility from soft to stiff, each having a leading edge for scraping and a second edge, each being adapted to be held by hand, said leading edge of the softest of said blade members protruding forward of that of the next stiffest blade member lying next to it, said stiffer blade members being recessed in a stepwise manner from soft to stiff; and b. means for rigidly and detachably fastening said blade members, said fastening means being spaced apart from said leading edges of said blade members.

2. The tool as described in claim 1, wherein said blade members are further rotatably attached by said fastening means and can be used separately and in various combinations.

3. The tool as described in claim 2, wherein said blade members include a softest blade member which can squeegee water and slush from the surfaces of interest, an intermediate flexibility member which can polish frost and crusty snow thereon, and a stiffer member which can remove light ice therefrom.

4. The tool as described in claim 3, wherein said blade members, when used separately and in combination, conform to the variations in the surface of interest, and ride over rivets and other small protruding appendages thereon.

5. The tool as described in claim 4, wherein said blade members include flat elastomeric plates each having a different, substantially constant room temperature Durometer D hardness value within the range from approximately 40D to 72D, said hardness value remaining constant to within about 13% in the temperature range from about 0° to −40° C., each blade member further having a different, substantially constant room temperature Clash-Berg Modulus of Rigidity within the range from about 2,100 psi to 19,000 psi, respectively, wherein said Modulus changes by less than a factor of approximately 7 in the temperature range from +23° to −40° C.

6. The tool as described in claim 5, wherein said flat elastomeric plates are fabricated from materials which include DuPont 'Hytrel' polyester elastomers.

7. The tool as described in claim 6, wherein said 'Hytrel' elastomeric plates are about 3" wide at said leading edge and approximately 0.08" thick.

8. The tool as described in claim 1, wherein said stiffest member employed further comprises a handle located between said leading edge and said second edge, said handle forming a rear portion of said leading edge.

9. The tool as described in claim 8, wherein said handle is formed from said stiffest member and wherein said handle is an integral part thereof.

10. The tool as described in claim 9, wherein said leading edge further comprises a broad, stepped scraping surface for polishing frost.

11. The tool as described in claim 10, wherein a flat, soft blade member for squeegeeing water is demountably and rigidly attached to said stiffest member by fastening means which are recessed below the surface thereof to prevent scratching the surface being cleaned, said soft blade member having a leading edge such that said leading edge of said soft blade member protrudes beyond said leading edge of said stiffest member, and is contiguous thereto over its entire length, and wherein said soft blade member may be rotated 180° and resecured in an out-of-the-way position.

12. The tool as described in claim 11, wherein said soft blade member lies flat against said stiffest member up to said stiffest member's leading edge, whereupon said soft blade member angles away from the plane of said stiffest member in a direction opposite to said stepped scraping surface forming a leading edge suitable for efficient squeegee action.

13. The tool as described in claim 12, wherein said second edge further comprises a narrower, stepped scraping surface for scraping light ice from the surface of interest.

14. The tool as described in claim 13, wherein said softest blade member is fabricated from at least one General Electric silicone rubber having an A.M.S. specification number selected from the group consisting of 3302D and 3303F and having a room temperature Durometer A hardness within the range from about 50A to 60A.

15. The tool as described in claim 14, wherein said stiffest blade member includes a flat elastomeric plate having a room temperature Durometer D hardness value within the range from approximately 55D to 72D wherein said Durometer D hardness value is constant to within about 13% in the temperature range from about 0° to −40° C., and wherein said elastomeric plate has a room temperature Clash-Berg Modulus of Rigidity within the range from about 8,800 psi to 19,000 psi, respectively, said Modulus changing by less than a factor of approximately 7 in the temperature range from about +23° to −40° C.

16. The tool as described in claim 15, wherein said flat elastomeric plate is fabricated from materials which include DuPont 'Hytrel' polyester elastomers.

17. The tool as described in claim 16, wherein said broad, stepped scraping surface is about 8" wide and about 0.24" thick at its thickest point, said steps each being approximately 0.08" thick, wherein said narrower, stepped scraping surface is about 2" wide and about 0.24" thick at its thickest point, said steps each being approximately 0.08" thick, and wherein said flat, soft blade member is about 8" wide and approximately 0.125" thick.

18. The tool as described in claims 7 or 17, wherein said elastomeric plates and said silicone rubber blades are chemically resistant to fuels and deicing fluids and are further resistant to sunlight.

19. The tool as described in claim 18, wherein said elastomeric plates are wetted by fuels in order that a line of fuel will persist on the surface of said elastomeric plates for a time period after said elastomeric plates are placed in fuel substantially near to the position of said line of fuel and then withdrawn therefrom.

20. The tool as described in claim 17, wherein said second edge fits into an aircraft fuel tank and said handle is calibrated and scribed such that when said handle is inserted into said fuel tank up to said rear portion of said broad, stepped scraping surface, a measurement of the fuel level is obtained from the location of the liquid fuel along said scribed handle when the tool is withdrawn from said tank.

21. A tool for removing light ice from delicate surfaces, which comprises a single, narrow, flat, anti-scratch blade adapted to be held by hand and formed from an elastomeric material having a room temperature Durometer D hardness value within the range from about 63D to 72D, said Durometer hardness value being constant to within about 13% in the temperature range from approximately 0° to −40° C. and having a room temperature Clash-Berg Modulus of Rigidity within the range from about 13,500 psi to 19,000 psi, respectively, said Modulus changing by less than a factor of approximately 7 in the temperature range from about +23° to −40° C.

22. A tool for polishing frost on delicate surfaces, which comprises a single, broad, flat, anti-scratch blade adapted to be held by hand and formed from an elastomeric material having a room temperature Durometer D hardness value within the range from about 63D to 72D and constant to within about 13% in the temperature range from approximately 0° to −40° C., and having a room temperature Clash-Berg Modulus of Rigidity within the range from about 13,500 psi to 19,000 psi, respectively, said Modulus changing by less than a factor of about 7 in the temperature range from about +23° to −40° C.

23. The tool as described in claims 21 or 22, wherein said elastomeric material includes DuPont 'Hytrel' polyester elastomers.

24. The tool as described in claim 23, wherein said narrow blade is about 2" wide and about 0.24" thick at its thickest point, said narrow blade having approximately 0.08" thick steps to increase surface contact, and wherein said broad blade is about 8" wide and about 0.24" thick at its thickest point, said broad blade having approximately 0.08" thick steps to increase surface contact.

* * * * *